US010895259B2

(12) United States Patent
Scala

(10) Patent No.: US 10,895,259 B2
(45) Date of Patent: Jan. 19, 2021

(54) SCREW COMPRESSOR HAVING SYNCHRONIZED ECONOMIZER PORTS

(71) Applicant: TRANE INTERNATIONAL INC., Davidson, NC (US)

(72) Inventor: Alberto Scala, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 270 days.

(21) Appl. No.: 15/958,858

(22) Filed: Apr. 20, 2018

(65) Prior Publication Data

US 2019/0323503 A1 Oct. 24, 2019

(51) Int. Cl.

| | |
|---|---|
| ***F01C 1/16*** | (2006.01) |
| ***F03C 2/00*** | (2006.01) |
| ***F03C 4/00*** | (2006.01) |
| ***F04C 2/00*** | (2006.01) |
| ***F04C 18/16*** | (2006.01) |
| ***F04C 2/16*** | (2006.01) |

(52) U.S. Cl.

CPC ..... *F04C 18/16* (2013.01); *F04C 2/16* (2013.01); *F04C 2240/20* (2013.01)

(58) Field of Classification Search

CPC ..... F04C 2/16; F04C 18/16; F04C 2240/20; F04B 39/06; F04B 39/062; F25B 31/002; F25B 31/006; F25B 31/008; F25B 2500/16

USPC ..... 418/15, 83, 91, 201.1

See application file for complete search history.

(56) References Cited

U.S. PATENT DOCUMENTS

| | | | | |
|---|---|---|---|---|
| RE30,499 | E * | 2/1981 | Moody, Jr. | F25B 31/008 62/117 |
| 5,174,741 | A * | 12/1992 | Tohgo | F04C 29/042 418/84 |
| 6,571,576 | B1 | 6/2003 | Lifson et al. | |
| 9,086,067 | B2 | 7/2015 | Masuda et al. | |
| 9,163,634 | B2 | 10/2015 | Picouet | |
| 2004/0035122 | A1 | 2/2004 | Lifson et al. | |
| 2006/0285966 | A1 | 12/2006 | Gotoh et al. | |
| 2010/0329918 | A1 | 12/2010 | Gotou et al. | |

(Continued)

FOREIGN PATENT DOCUMENTS

| | | |
|---|---|---|
| DE | 10326467 A1 | 12/2004 |
| DE | 10334947 | 2/2005 |
| EP | 0564123 | 10/1993 |

(Continued)

OTHER PUBLICATIONS

Extended European Search Report; European Patent Application No. 19170424.6; dated Sep. 24, 2019 (7 pages).

*Primary Examiner* — Theresa Trieu

(74) *Attorney, Agent, or Firm* — Hamre, Schumann, Mueller & Larson, P.C.

(57) ABSTRACT

This disclosure relates generally to economized screw compressors. Particularly, this synchronized economizer ports on both the female and the male rotor sides of a compressor housing. The economizer ports simultaneously provide gas to a compression chamber formed by male and female rotors. The synchronized male side and female side economizer ports are configured to open and close at opening and closing angles, respectively. The opening angles and the closing angles each differ by at most half of an angular width of a male lobe of the compressor.

10 Claims, 8 Drawing Sheets

(56) References Cited

U.S. PATENT DOCUMENTS

2015/0345833 A1* 12/2015 Haley ..... F25B 31/008
62/117

FOREIGN PATENT DOCUMENTS

| | | |
|---|---|---|
| EP | 0775826 | 5/1997 |
| WO | 2017/027657 A1 | 2/2017 |

* cited by examiner

SCREW COMPRESSOR HAVING SYNCHRONIZED ECONOMIZER PORTS

FIELD

This disclosure relates generally to economized screw compressors. Particularly, this disclosure relates to economized screw compressors having synchronized economizer ports on both the female and the male rotor sides of a compressor housing.

BACKGROUND

Compressors may include economizer circuits, which feed gas at an intermediate pressure into the compressor between the suction and discharge. This increases the gas throughput of the compressor and can realize improvements in cooling capacity and/or efficiency.

Increasing the flow through an economizer increases the improvements in cooling capacity and/or efficiency realized by the economizer. However, port sizes and the pressure at the economizer port as a result of flow through the port restricts the quantity of flow that can be provided. Currently, flow through economizers is increased by the following approaches: increasing port size, using multiple ports on the same side of the compressor and in close proximity, or using an elongated slot-shaped port.

BRIEF SUMMARY

This disclosure relates generally to economized screw compressors. Particularly, this disclosure relates to economized screw compressors having synchronized economizer ports on both the female and the male rotor sides of a compressor housing.

Economizers improve compressor capacity and/or efficiency through the introduction of additional gas during compression. The effect of an economizer can be improved by increasing the volume of gas introduced into the compressor. One way to do this is by including multiple economizer ports. Multiple economizer ports typically are located in proximity to one another on one side of the compressor, and are positioned following the helical shape of the lobes of screw rotors in order to each communicate with the same compression chamber during operation of the compressor. When multiple economizer ports are in close proximity and positioned sequentially with respect to a compression chamber, flow through upstream economizer ports produces pressure at the outlets of economizer ports further downstream and reduces the flow through those downstream ports. By instead placing multiple economizer ports spaced from one another in the compressor and synchronized with each other, the flow can be increased without altering the timing or compression angles of the screw compressor.

Separating the economizer ports in space within the compressor provides improved flow distribution and provides the compressor with improved volumetric efficiency. Further, distributing economizer ports on both the male and female sides simplifies the accommodation of multiple economizer ports over the limited length of the compressor housing compared to designs including multiple ports arranged in sequence on one part of the housing.

By using holes instead of slots as the opening of the economizer ports, the machining of compressor components is simplified. Further, holes can achieve furtherhomogeneous flow and volumetric efficiency improvements by using multiple, separate, synchronized ports placed at different parts of the compressor. The improved flow also reduces noise and smooths pulsation in the compressor.

In an embodiment, a screw compressor includes a compressor housing, a male rotor located in the compressor housing on a male rotor housing side, a female rotor located in the compressor housing on a female rotor side and configured to engage the male rotor, a first economizer port on the male rotor side, and a second economizer port located on the female rotor side. The first economizer port and second economizer port are configured to provide gas to a compression chamber formed by the male rotor and the female rotor simultaneously.

In an embodiment, the first and second economizer ports open at compression angles having a difference of less than half an angular width of a lobe of the male rotor, where the angular width is 360° divided by the number of lobes of the male rotor. In an embodiment, the first and second economizer ports open at compression angles that are equal. In an embodiment, the first and second economizer ports close at compression angles having a difference of less than half an angular width of a lobe of the male rotor. In an embodiment, the first and second economizer ports close at compression angles that are equal.

In an embodiment, the first and second economizer ports are located between at or about 5 and at or about 10 degrees following a position where the male rotor and female rotor form the compression chamber.

In an embodiment, a method of operating a screw compressor includes injecting a flow of gas to a compression chamber via a first economizer port on a male rotor side of the screw compressor and a second economizer port on a female rotor side of the screw compressor, and the first and second economizer ports provide the flow of gas to the compression chamber simultaneously.

DETAILED DESCRIPTION

This disclosure relates generally to economized screw compressors. Particularly, this disclosure relates to economized screw compressors having synchronized economizer ports on both the female and the male rotor sides of a compressor housing. The economizer may be particularly beneficial in high compression pressure ratio applications such as in heating, ventilation, air conditioning and refrigeration (HVACR) systems, for example implemented in an air-cooled chiller, but is also applicable to other applications having relatively lower compression ratios such as water-cooled chillers.

Figure 1:
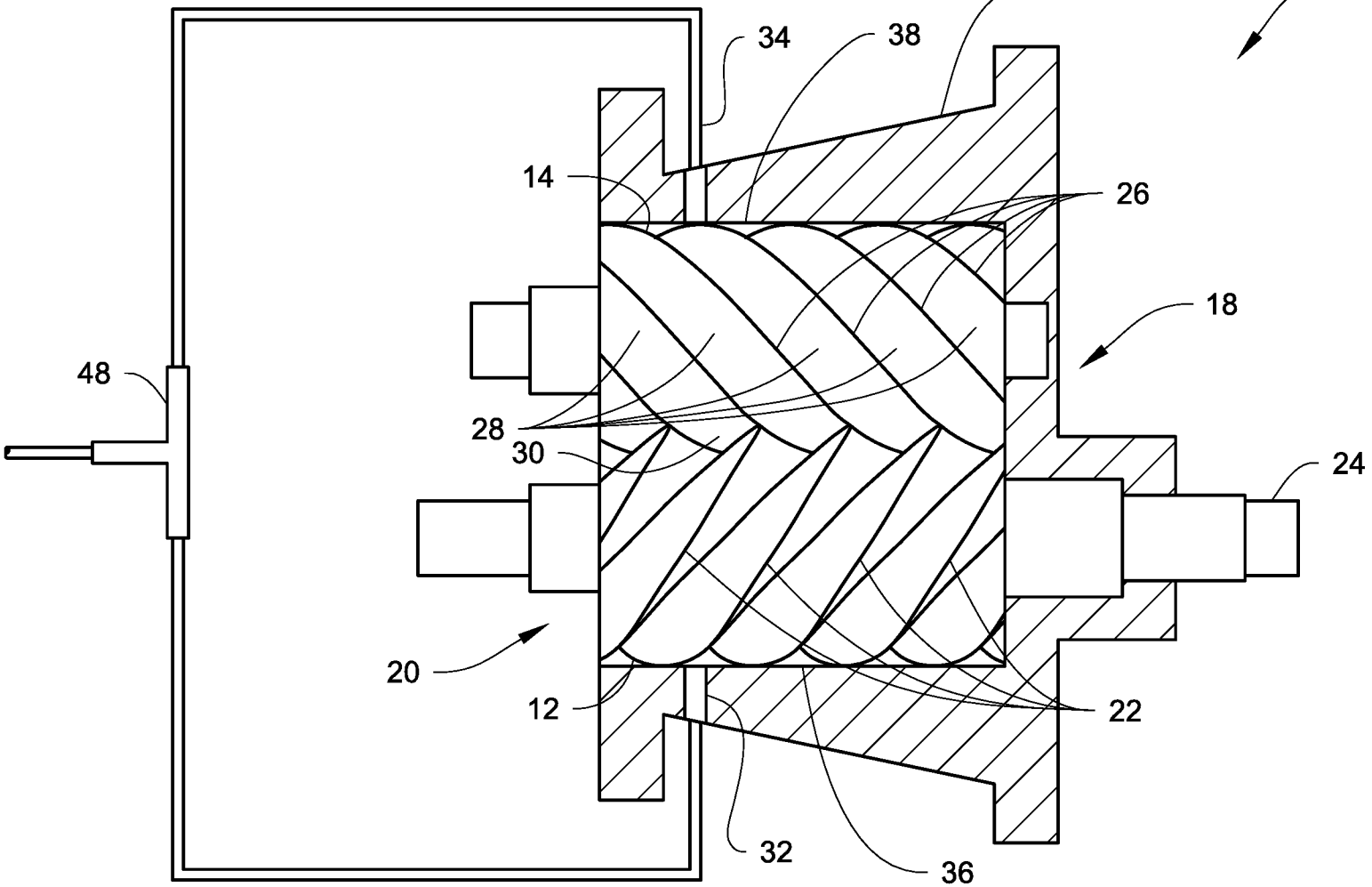
FIG. 1 shows a screw compressor according to an embodiment.

FIG. 1 shows a screw compressor according to an embodiment. Screw compressor 10 includes male rotor 12 and female rotor 14 located within compressor housing 16. Compressor housing 16 has a male side economizer port 32 on a side of the compressor housing including a cavity accommodating the male rotor 12. Compressor housing 16 has a female side economizer port 34 on a side of the compressor housing including a cavity accommodating the female rotor 14.

Compressor housing 16 contains the male rotor 12 and female rotor 14. Compressor housing 16 has a suction end 18 and a discharge end 20. Suction end 18 is where gas enters the compressor, and discharge end 20 where gas exits the compressor housing. Compressor housing 16 has a first cavity 36 to accommodate male rotor 12 and a second cavity 38 to accommodate female rotor 14.

Male rotor 12 has a plurality of lobes 22. In an embodiment, male rotor 12 has five lobes. Each lobe of male rotor 12 projects outwards. Each of the lobes 22 of male rotor 12 twists in a helix over the longitudinal direction of the rotor. In an embodiment, male rotor 12 is driven by shaft 24. The number of lobes on the male rotor 12 may be selected based on, for example, the desired compression ratio of the screw compressor 10. For example, in air conditioning applications the compression pressure ratio may be, for example, between approximately 1.7 at part load up to approximately 4.5 at full load, there may four or five lobes on male rotor 12 and five to seven lobes on the female rotor 14. In refrigeration applications, the compression pressure ratio may be approximately 10, there may be six lobes on male rotor 12, and seven or eight lobes on female rotor 14. The number of lobes on male rotor 12 and female rotor 14 may also vary with aspects of compressor design such as the wrap angle, the gas/oil ratio, and/or the profile length vs. rotor diameter. In an embodiment, the male rotor 12 has between 3 and 6 lobes. In an embodiment, the male rotor 12 has 5 lobes.

Female rotor 14 is configured to engage with male rotor 12. In an embodiment, female rotor 14 has a plurality of lobes 26 separated by depressions 28. In an embodiment, the female rotor 14 has between 5 and 7 lobes. In an embodiment, male rotor 12 has 5 lobes 22 and female rotor 14 has 6 lobes 26. Each of the lobes of female rotor 14 twists in a helix over the longitudinal direction of the rotor. In an embodiment, depressions 28 in female rotor 14 are configured to receive the lobes 22 of male rotor 12. Engagement of female rotor 14 with the male rotor 12 together with the compressor housing 16 forms compression chamber 30. Engagement of male rotor 12 with depression 28 in female rotor 14 may be used to drive the rotation of female rotor 14. As the male rotor 12 and female rotor 14 rotate, the trailing edges of each of the lobes 22 of the male rotor 12 and the lobes 26 following each depression 28 of female rotor 14 seal compression chamber 30 from the suction end 16 of the compressor housing 16.

Male side economizer port 32 is an opening extending through the compressor housing 16, from an outer surface of the compressor housing 16 to the first cavity accommodating the male rotor 12. The relative position of the economizer ports between the suction and discharge ports influences whether the economizer primarily improves compressor capacity or efficiency. In the embodiment shown in FIG. 1, the male and female side economizer ports 32 and 34 are positioned to primarily improve the capacity of the screw compressor 10. In the embodiment shown in FIG. 1, the male side economizer port 32 is located proximate to a discharge end 20 of compressor housing 16. Male side economizer port 32 may be located proximate to a suction end 18 of compressor housing 16. Male side economizer port 32 allows gas to be introduced into a compression chamber 30. Male side economizer port 32 is located on compressor housing 16 at a position following where compression chamber 30 is sealed from the suction end 18 by compressor housing 16, for example at a position at or about 5 to at or about 10 degrees of rotor rotation following where compression chamber 30 is sealed from suction end 18 by compressor housing 16.

Female side economizer port 34 is an opening extending through the compressor housing 16, from an outer surface of the compressor housing 16 to the second cavity accommodating the female rotor 14. In FIG. 1, female side economizer port is located proximate to a discharge end 20 of compressor housing 16. Female side economizer port 34 may be proximate to the suction end 18 of the compressor housing 16. Female side economizer port 34 is located on compressor housing 16 at a position following where compression chamber 30 is sealed from the suction end 18 by compressor housing 16, for example at a position at or about 5 to at or about 10 degrees of rotor rotation following where compression chamber 30 is sealed from suction end 18 by compressor housing 16.

The female side economizer port 34 and the male side economizer port 32 are positioned such that both can introduce gas into the same compression chamber 30 simultaneously during at least a portion of the time the compression chamber is active or sealed from the suction end 18 of the compressor housing 16. The amount of time compression chamber 30 is formed by male rotor 12, female rotor 14 and compressor housing 16 varies based on the speed at which the male rotor 12 rotates. In an embodiment, the male side economizer port 32 and the female side economizer port 34 are configured to open and close at the same angles of rotation of the male rotor 12 and the female rotor 14. In an embodiment, the male side economizer port 32 and female side economizer port are within about 72 degrees of one another with respect to the rotation of the rotors. In an embodiment, the male side economizer port 32 and the female side economizer port 34 are each at the same angle with respect to compression chamber 30. In an embodiment, the male side economizer port 32 and the female side economizer port 34 are the same size. In an embodiment, the male side economizer port 32 and the female side economizer port 34 receive flow from the same or different gas source (not shown). The gas source may be any suitable gas source used to provide gas to an economizer in a compressor, such as, but not limited to, a downstream portion of a refrigerant circuit such as, but not limited to, an intermediate pressure line between a condenser and an evaporator of the refrigerant circuit, a tank, and the like. In an embodiment, the flow from the gas source to the male side economizer port 32 and the female side economizer port 34 is divided by a tee 48.

Figure 2A:
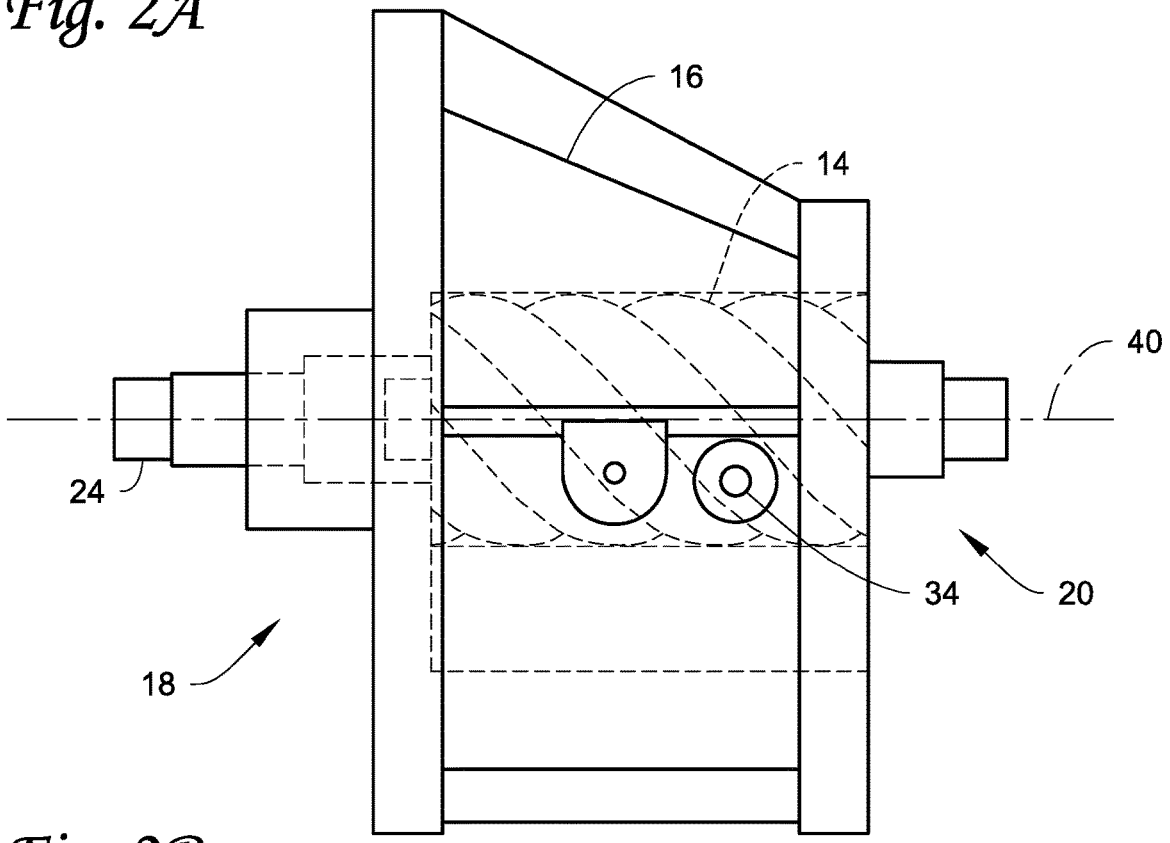
FIGS. 2A and 2B show views of a screw compressor according to an embodiment.
Figure 2B:
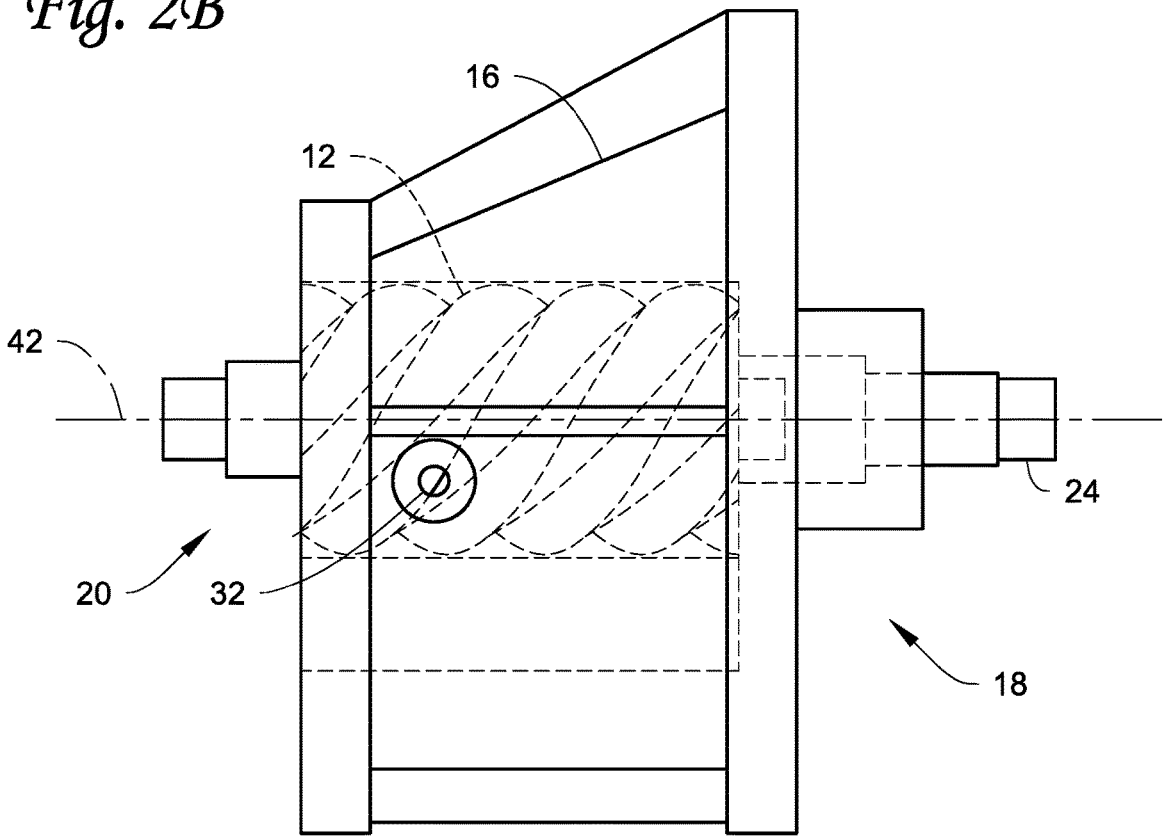

FIGS. 2A and 2B show views of the screw compressor shown in FIG. 1. FIG. 2A shows a view of the screw compressor embodiment from a female rotor side. FIG. 2B shows a view of the screw compressor embodiment from a male rotor side.

FIG. 2A shows the screw compressor 10 viewed from a female rotor side. Compressor housing 16 encloses female rotor 14. Compressor housing 16 has a female side economizer port 34 on the female rotor side. Female side economizer port 34 extends through the compressor housing 16 to place the cavity containing female rotor 14 in communication with a gas source (not shown). Male rotor drive shaft 24 extends from male rotor 12. In an embodiment, female side economizer port 34 is located below a center line 40 of female rotor 14.

FIG. 2B shows the screw compressor 10 viewed from a male rotor side. Compressor housing 16 has a male side economizer port 32. Male side economizer port 32 extends through the compressor housing to place the cavity containing male rotor 12 in communication with a gas source (not shown). A common gas source or a different gas source may be used with both the male side economizer port 32 and the female side economizer port 34. Male side economizer port 32 and female side economizer port 34 may be positioned with respect to the rotors and the suction end of compressor housing 16 such that both male side economizer port 32 and female side economizer port 34 provide gas to the same compression chamber 30 simultaneously during at least a portion of the time the compression chamber 30 is active. Compressor housing 16 encloses male rotor 12. Male rotor drive shaft 24 extends from male rotor 12. In an embodiment, male side economizer port 32 is located below a center line 42 of male rotor 12.

FIGS. 3A-3D shows the rotors and the compression chamber of an example embodiment of a screw compressor 50 at a series of compression angles corresponding to opening and closure of economizer ports as the male rotor 52 and female rotor 54 of the screw compressor 50 rotate. The compression angle is the current angle of the rotors with respect to a reference position. For example, the reference position may be a position where the center of the male rotor 52, the center of the female rotor 54, and a tip of a lobe of the male rotor 52 are in line with one another, and the compression angle may be defined as an angle between that line and the current position of the tip of the lobe of male rotor 52 with respect to the center of male rotor 52. In the screw compressor 50 shown in FIGS. 3A-3D, the male rotor 52 has 5 lobes and the female rotor 54 has 6 depressions. The angle between the corresponding portions of each lobe of the male rotor 52 is θ. In the embodiment shown in FIGS. 3A-3D, θ is 72°. In an embodiment having 5 lobes on male rotor 52, such as the embodiment shown in FIGS. 3A-3D, each compression chamber 56 is formed by one of the lobes of the male rotor 52 and one of the depressions in the female rotor over about 72 degrees of rotation in the compression angle. In embodiments having different numbers of rotors, the angle over which the compression chamber 56 is formed may vary, for example being 360 degrees divided by the number of lobes of the male rotor.

Figure 3A:
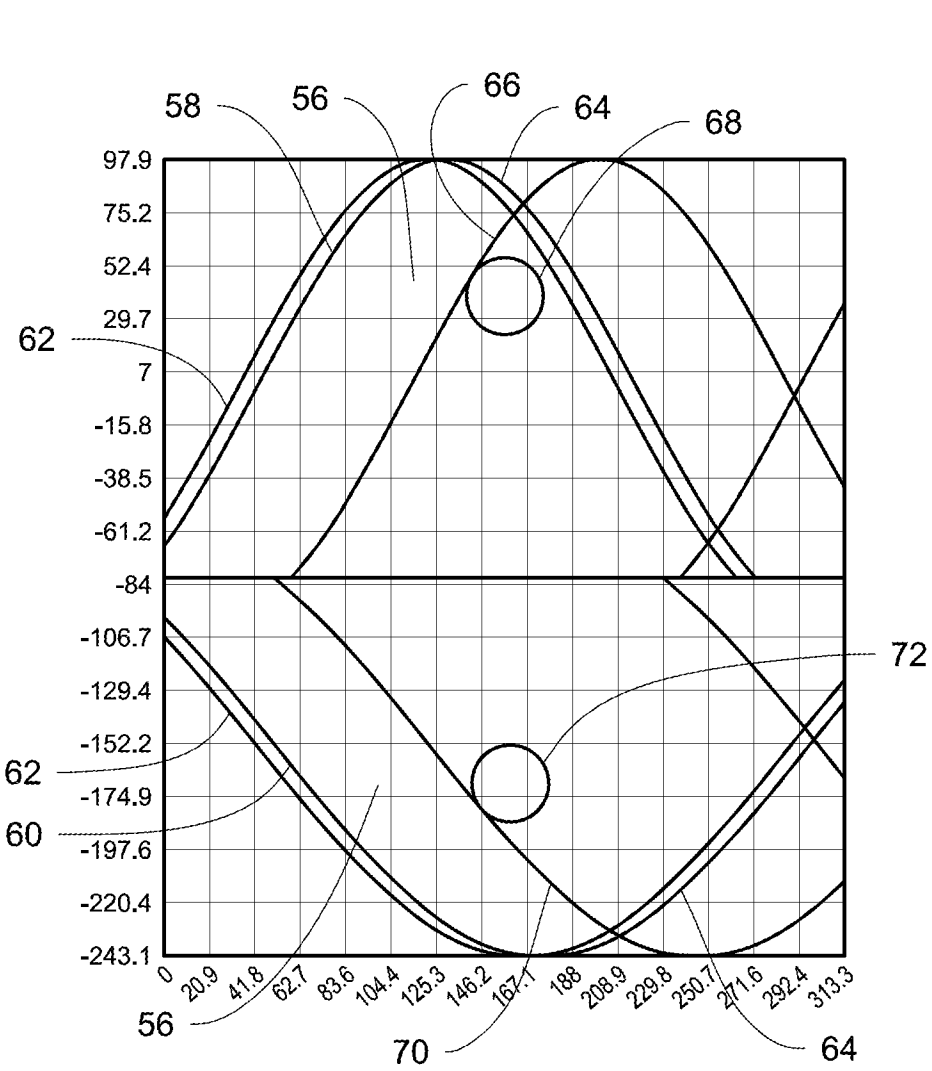
FIGS. 3A-3D shows the rotors and the compression chamber of an embodiment at a series of compression angles corresponding to opening and closure of economizer ports.
Figure 3A:
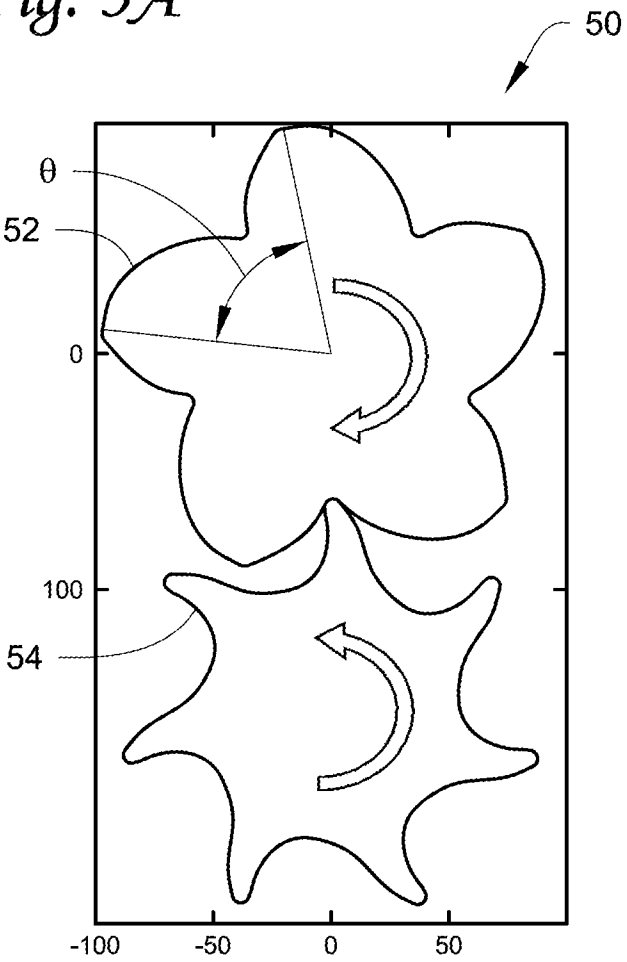

In FIG. 3A, the compression angle of the screw compressor of this embodiment is at or about 25 degrees. At this compression angle, the male trailing edge 58 of the male rotor 52 and the female trailing edge 60 of the female rotor 54 have each just passed where the compressor chamber 56 is sealed from the suction end 62 of the compressor housing 64. The male rotor 52 and the female rotor 54, along with the compressor housing 64, form a compression chamber 56 at this point. At this compression angle, the male leading edge 66 of the male rotor 52 begins to pass the male side economizer port 68. At this compression angle, the female leading edge 70 of the female rotor 54 begins to pass the female side economizer port 72. The male side economizer port 68 and the female side economizer port 72 each provide gas to the compression chamber 56 as the leading edges pass the economizer ports 68, 72 and expose the economizer ports 68, 72 to the compression chamber 56.

Figure 3B:
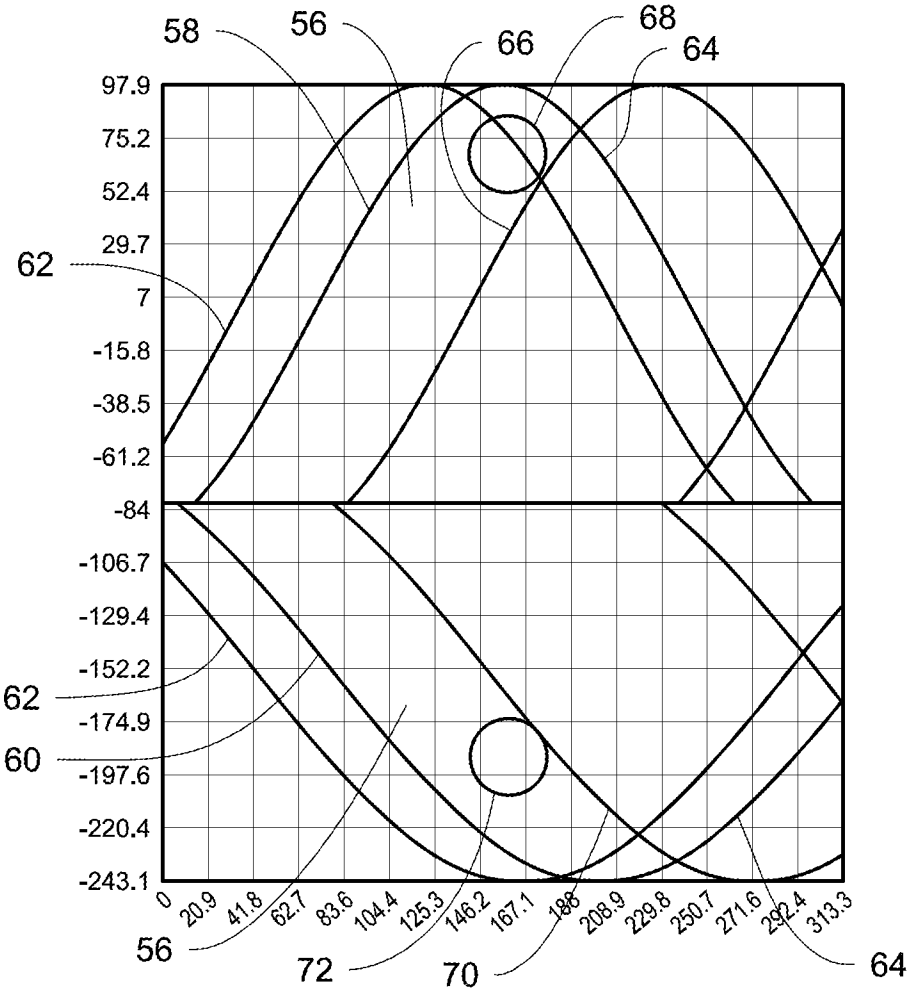
Figure 3B:
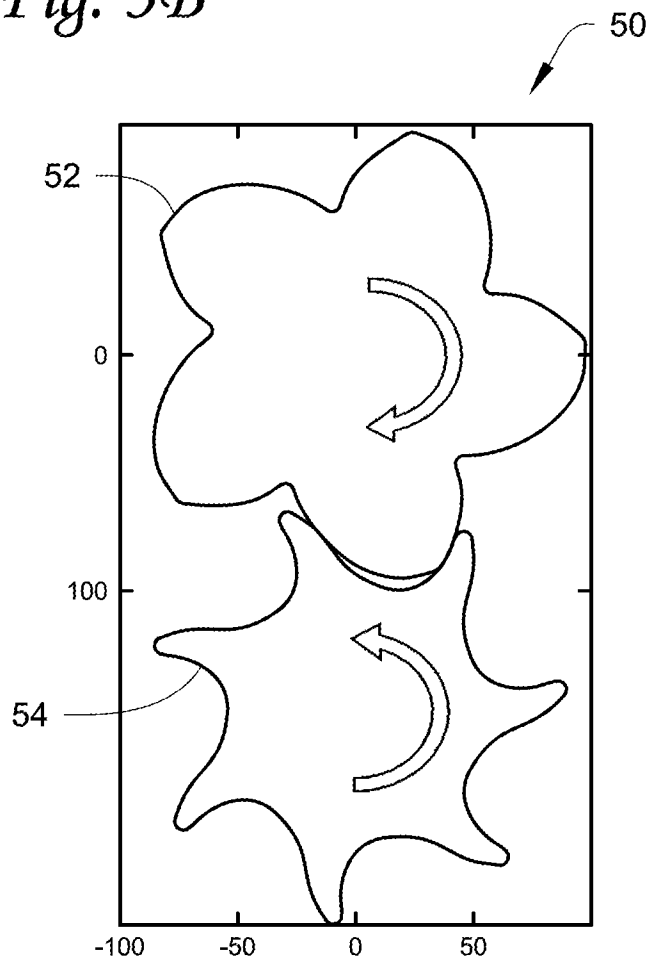

In FIG. 3B, the rotors have rotated such that the compression angle is now at or about 53 degrees. At this compression angle, the male leading edge 66 has completely passed the male side economizer port 68 and the female leading edge 70 has completely passed the female economizer port 72. Each of the male economizer port 68 and the female economizer port 72 are now fully open to the compression chamber 56 formed by the compressor housing 64, the male rotor 52 and the female rotor 54.

Figure 3C:
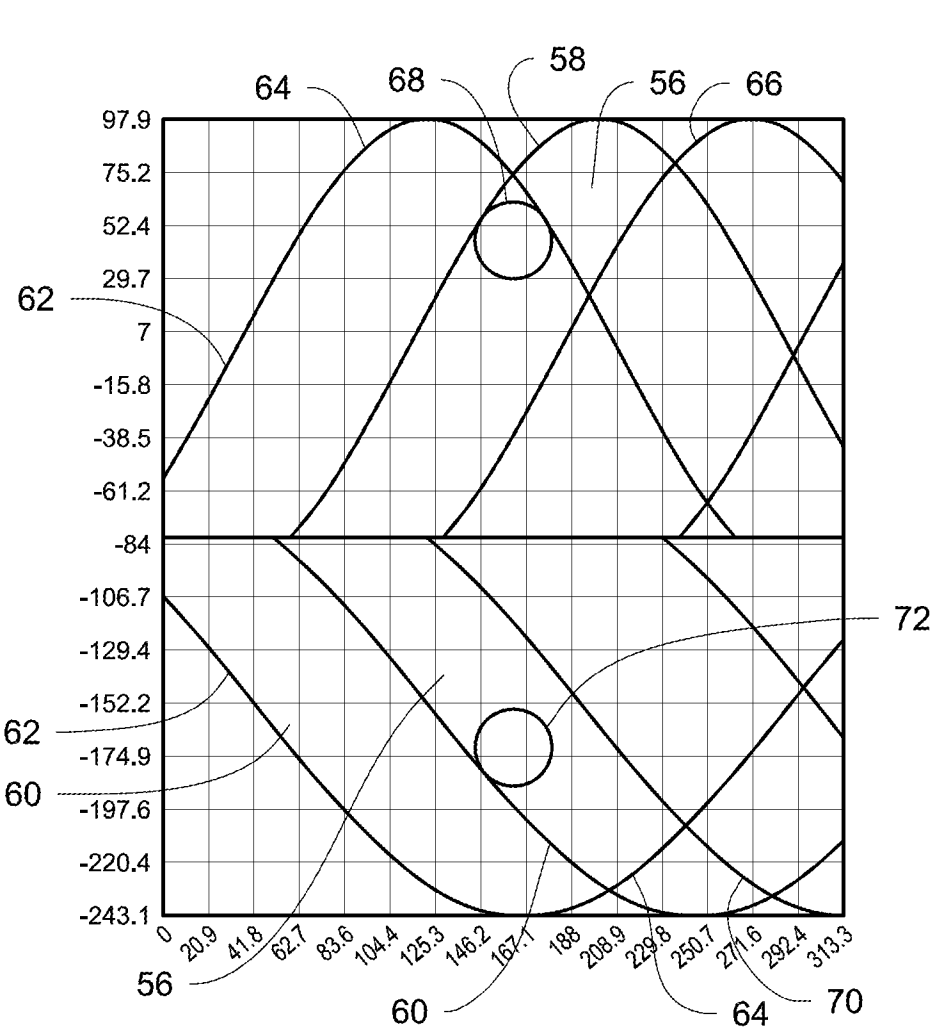
Figure 3C:
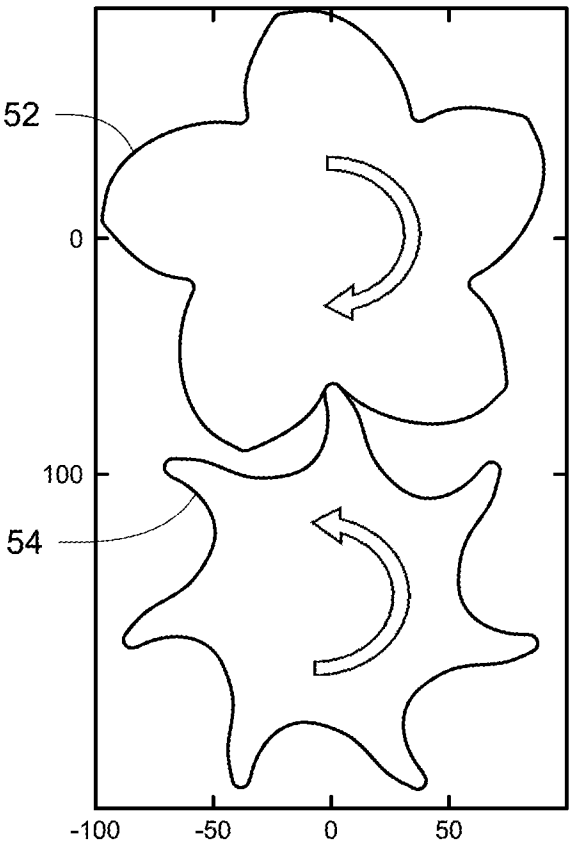

In FIG. 3C, the rotors have rotated such that the compression angle is now at or about 97 degrees. At this compression angle, the male trailing edge 58 begins to pass the opening of the male side economizer port 68. At this compression angle, the female trailing edge 60 begins to pass the opening of the female side economizer port 72. As the trailing edges pass the openings of the respective economizer ports, the ports begin to close with respect to compression chamber 56.

Figure 3D:
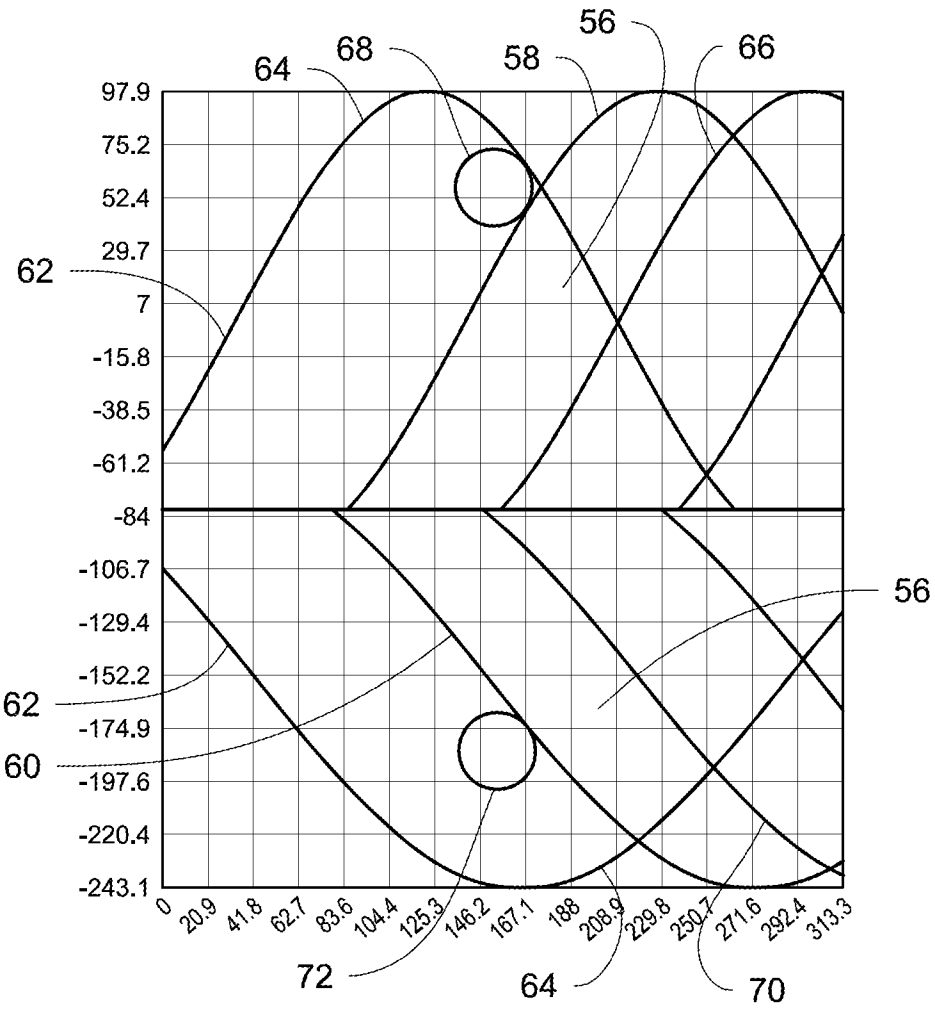
Figure 3D:
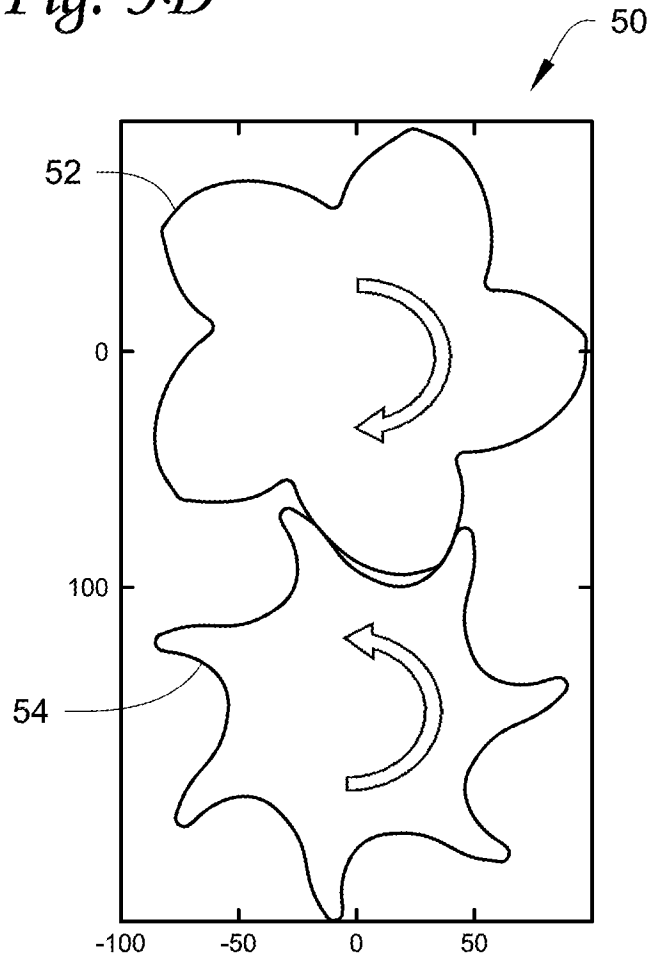

In FIG. 3D, the rotors have rotated such that compression angle is now at or about 125 degrees. At this compression angle, the male trailing edge 58 has completely passed the male side economizer port 68. At this compression angle, female trailing edge 60 has completely passed the female side economizer port 72. The male side economizer port 68 and the female side economizer port 72 are both now completely closed with respect to compression chamber 56. In an embodiment, the economizer ports 68 and 72 together provide up to or approximately 10% of the mass flow through the compressor during their operation.

In the example embodiment shown in FIGS. 3A-3D, the opening and closing of each of the male side economizer port 68 and the female side economizer port 72 to the compression chamber 56 each occur at equal compression angles. In an embodiment, the opening of the male side economizer port and the female side economizer port may occur at different compression angles. In an embodiment, the closing of the male side economizer port and the female side economizer port may occur at different compression angles. The difference in compression angles for opening male and female side economizer ports and/or closing male and female may be up to or about half of the angular width of a lobe of the male rotor. The angular width of a lobe of a male rotor is 360 degrees divided by the number of lobes of the male rotor, e.g. 180 degrees for a two lobe rotor, or 60 degrees for a six lobe rotor. For example, the opening compression angle of the male side economizer port and the opening compression angle of the female side economizer port are within ±36 degrees of one another in a compressor where the male rotor has 5 lobes.

Figure 4A:
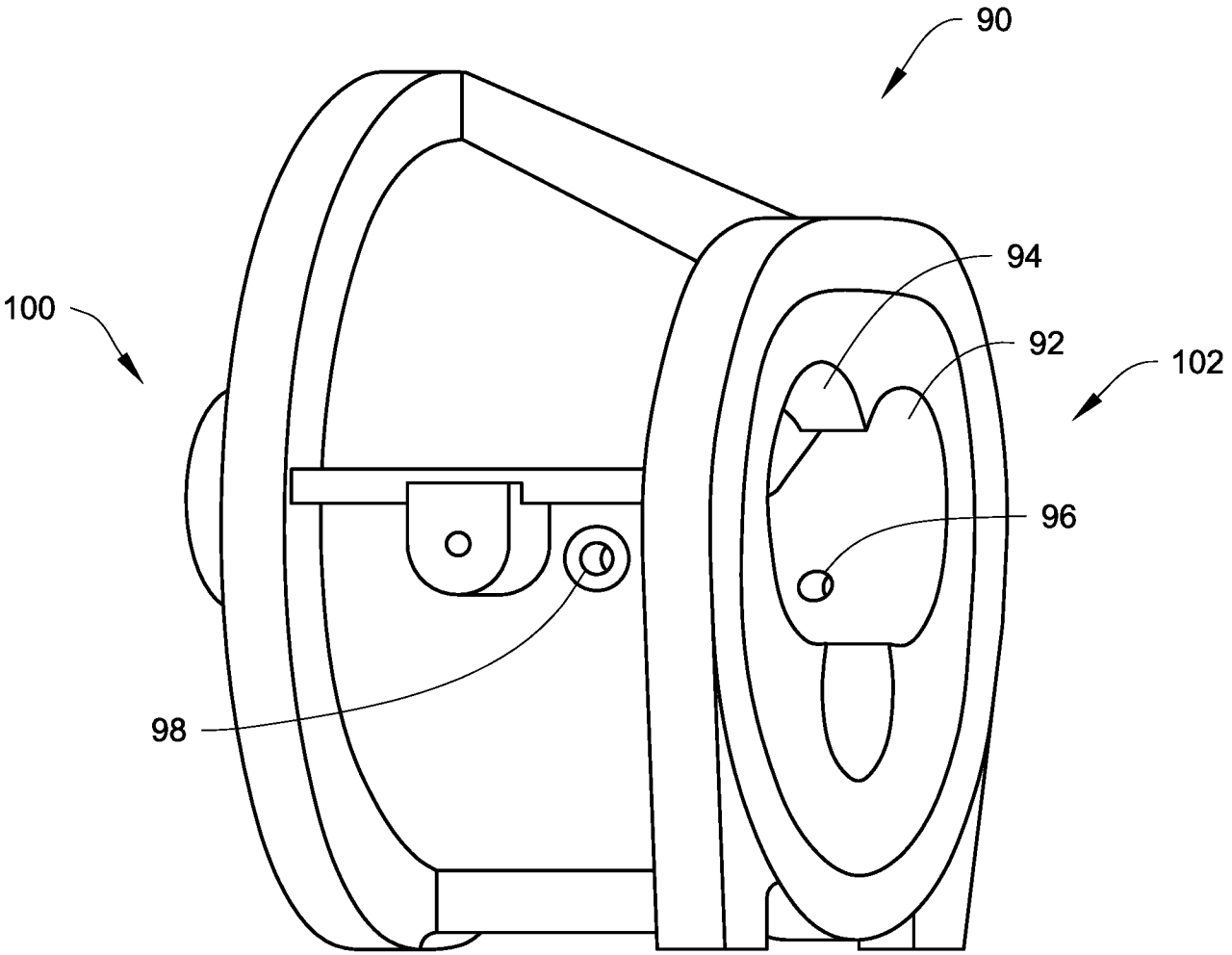
FIGS. 4A and 4B show compressor housings according to an embodiment.

FIG. 4A shows a compressor housing according to an embodiment. Compressor housing 90 includes a male rotor cavity 92, a female rotor cavity 94, a male side economizer port 96 and a female side economizer port 98. Compressor housing 90 has a suction end 100 and a discharge end 102. Male side economizer port 96 and female side economizer port 98 are each located on the compressor housing such that they are following where a compression chamber is sealed from the suction end 100 by compressor housing 90, for example at a position at or about 5 to at or about 10 degrees of rotor rotation following where the compression chamber is sealed from suction end 100 by a male rotor in male rotor cavity 92, a female rotor in female rotor cavity 94, and compressor housing 90.

Figure 4B:
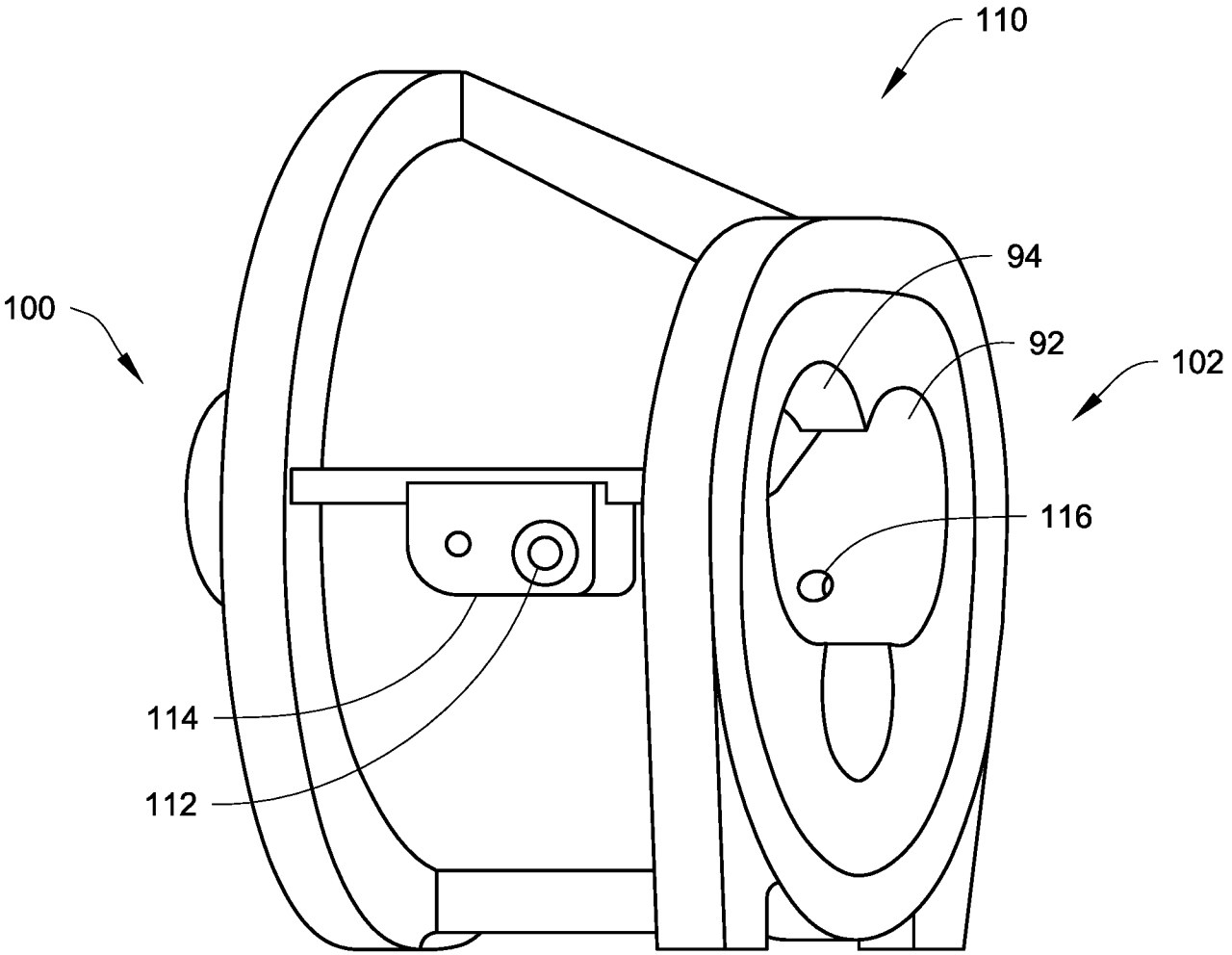

FIG. 4B shows a compressor housing according to another embodiment. In the embodiment shown in FIG. 4B, compressor housing 110 includes female side economizer port 112, located on boss 114 on the female rotor cavity 94 side of the compressor housing 110. Boss 114 extends outwards from the surface of compressor housing 110. The male side economizer port 116 is located on a corresponding boss (not shown) on the male rotor cavity 92 side of the compressor housing 110, and extending outwards from the surface of the compressor housing 110. The male side economizer port 112 and the female side economizer port 114 are located on the compressor housing 110 such that they are following where a compression chamber is sealed from the suction end 100 by compressor housing 110, for example at a position at or about 5 to at or about 10 degrees of rotor rotation following where the compression chamber is sealed from suction end 100 by a male rotor in male rotor cavity 92, a female rotor in female rotor cavity 94, and compressor housing 110.

EMBODIMENTS

It is understood that any of embodiments 1-6 and 7-12 may be combined.

Embodiment 1

A screw compressor, comprising:

a compressor housing;

a male rotor located in the compressor housing on a male rotor side;

a female rotor located in the compressor housing on a female rotor side and configured to engage the male rotor;

a first economizer port on the male rotor side of the compressor housing; and a second economizer port on the female rotor side of the compressor housing, wherein the first economizer port and the second economizer port are configured to simultaneously provide gas to a compression chamber formed by the male rotor and the female rotor.

Embodiment 2

The screw compressor according to embodiment 1, wherein the first economizer port is configured to open at a first opening compression angle, and the second economizer port is configured to open at a second opening compression angle, wherein the difference between the first opening compression angle and the second opening compression angle is less than half an angular width of a lobe of the male rotor.

Embodiment 3

The screw compressor according to embodiment 2, wherein the first opening compression angle and the second opening compression angle are equal.

Embodiment 4

The screw compressor according to any of embodiments 1-3, wherein the first economizer port is configured to close at a first closing compression angle and the second economizer is configured to close at a second closing compression angle, wherein the difference between the first closing compression angle and the second closing compression angle is less than half an angular width of a lobe of the male rotor.

Embodiment 5

The screw compressor according to embodiment 4, wherein the first closing compression angle and the second closing compression angle are equal.

Embodiment 6

The screw compressor according to any of embodiments 1-5, wherein the first economizer port and the second economizer port are located between 5 and 10 degrees following a position where the male rotor and female rotor form the compression chamber.

Embodiment 7

A method of operating a screw compressor, comprising:

injecting a flow of gas to a compression chamber via a first economizer port on a male rotor side of the screw compressor and a second economizer port on a female rotor side of the screw compressor, wherein the first economizer port and the second economizer port provide the flow of gas to the compression chamber simultaneously.

Embodiment 8

The method according to embodiment 7, wherein the first economizer port opens at a first opening compression angle, and the second economizer port opens at a second opening compression angle, wherein the difference between the first opening compression angle and the second opening compression angle is less than half an angular width of a lobe of the male rotor.

Embodiment 9

The method according to embodiment 8, wherein the first opening compression angle and the second opening compression angle are equal.

Embodiment 10

The method according to any of embodiments 7-9, wherein the first economizer port closes at a first closing compression angle and the second economizer closes at a second closing compression angle, wherein the difference between the first closing compression angle and the second closing compression angle is less than half an angular width of a lobe of the male rotor.

Embodiment 11

The method according to embodiment 10, wherein the first closing angle and the second closing compression angle are equal.

Embodiment 12

The method according to any of embodiments 7-11, wherein the first economizer port and the second economizer port are located between 5 and 10 degrees following a position where the male rotor and female rotor form the compression chamber.

Embodiment 13

An HVACR system comprising the screw compressor of any of embodiments 1-6.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A screw compressor, comprising:

a compressor housing;

a male rotor located in the compressor housing on a male rotor side;

a female rotor located in the compressor housing on a female rotor side and configured to engage the male rotor;

a first economizer port on the male rotor side of the compressor housing; and a second economizer port on the female rotor side of the compressor housing, wherein the first economizer port and the second economizer port are configured to simultaneously provide gas to a compression chamber formed by the male rotor and the female rotor, the first economizer port and the second economizer port are each located between 5 and 10 degrees of rotation of the male rotor and the female rotor following a position where the male rotor and female rotor form the compression chamber, and the first economizer port is configured to close at a first closing compression angle and the second economizer is configured to close at a second closing compression angle, wherein a difference between the first closing compression angle and the second closing compression angle is less than half an angular width of a lobe of the male rotor, wherein the angular width is 360 degrees divided by a number of lobes of the male rotor.

2. The screw compressor of claim 1, wherein the first economizer port is configured to open at a first opening compression angle, and the second economizer port is configured to open at a second opening compression angle, wherein a difference between the first opening compression angle and the second opening compression angle is less than half an angular width of a lobe of the male rotor.

3. The screw compressor of claim 2, wherein the first opening compression angle and the second opening compression angle are equal.

4. The screw compressor of claim 1, wherein the first closing compression angle and the second closing compression angle are equal.

5. The screw compressor of claim 1, wherein each of the first economizer port and the second economizer port are round holes.

6. A method of operating a screw compressor, comprising:

a compressor housing including a first cavity accommodating a male rotor and a second cavity accommodating a female rotor;

injecting a flow of gas to a compression chamber via a first economizer port on a male rotor side of the screw compressor; and injecting a flow of the gas to the compression chamber via a second economizer port on a female rotor side of the screw compressor, wherein the first economizer port and the second economizer port provide the flow of gas to the compression chamber simultaneously, the first economizer port and the second economizer port are located between 5 and 10 degrees of rotation of the male rotor and the female rotor following a position where the male rotor and female rotor form the compression chamber, and the first economizer port closes at a first closing compression angle and the second economizer closes at a second closing compression angle, wherein a difference between the first closing compression angle and the second closing compression angle is less than half an angular width of a lobe of the male rotor, wherein the angular width is 360 degrees divided by a number of lobes of the male rotor.

7. The method of claim 6, wherein the first economizer port opens at a first opening compression angle, and the second economizer port opens at a second opening compression angle, wherein a difference between the first opening compression angle and the second opening compression angle is less than half an angular width of a lobe of the male rotor.

8. The method of claim 7, wherein the first opening compression angle and the second opening compression angle are equal.

9. The method of claim 6, wherein the first closing compression angle and the second closing compression angle are equal.

10. The method of claim 6, wherein each of the first economizer port and the second economizer port are round holes.

* * * * *